US007616160B2

(12) United States Patent
Chen

(10) Patent No.: US 7,616,160 B2
(45) Date of Patent: Nov. 10, 2009

(54) ANTENNA MODULE AND RELATED ELECTRONIC DEVICE

(75) Inventor: Yin-Yu Chen, Taipei Hsien (TW)

(73) Assignee: Wistron Corporation, Hsi-Chih, Taipei Hsien (TW)

( * ) Notice: Subject to any disclaimer, the term of this patent is extended or adjusted under 35 U.S.C. 154(b) by 434 days.

(21) Appl. No.: 11/749,759

(22) Filed: May 17, 2007

(65) Prior Publication Data

US 2008/0055172 A1 Mar. 6, 2008

(30) Foreign Application Priority Data

Sep. 6, 2006 (TW) ..... 95215845 U

(51) Int. Cl.
*H01Q 1/24* (2006.01)

(52) U.S. Cl. ..... 343/702; 343/722; 343/729

(58) Field of Classification Search ..... 343/702, 343/722, 729, 725, 853, 850
See application file for complete search history.

(56) References Cited

U.S. PATENT DOCUMENTS

| | | | | |
|---|---|---|---|---|
| 7,466,975 | B2 * | 12/2008 | Feher | 455/404.2 |
| 7,558,574 | B2 * | 7/2009 | Feher | 455/440 |
| 2007/0032250 | A1 * | 2/2007 | Feher | 455/456.2 |
| 2007/0296632 | A1 * | 12/2007 | Opshaug | 342/450 |
| 2009/0061715 | A1 * | 3/2009 | Evans | 442/301 |
| 2009/0167945 | A1 * | 7/2009 | Tsui et al. | 348/552 |

* cited by examiner

*Primary Examiner*—HoangAnh T Le
(74) *Attorney, Agent, or Firm*—Winston Hsu

(57) ABSTRACT

An electronic device and a related antenna module for integrating GPS signals and digital mobile television signals are provided. With variances of both frequency domains and bandwidths between GPS signals and digital mobile television signals in the VHF and UHF bands, said signals may be transmitted inside the electronic device with different paths without interfering with each other.

19 Claims, 10 Drawing Sheets

ANTENNA MODULE AND RELATED ELECTRONIC DEVICE

BACKGROUND OF THE INVENTION

1. Field of the Invention

The present invention relates to an electronic device and an antenna module, and more particularly, to an electronic device and an antenna module for integrating a global positioning system antenna and a digital mobile television antenna.

2. Description of the Prior Art

With gradual growth of electronic products, certain electronic products may receive radio global positioning system (GPS) signals or digital mobile television (DIMO TV) signals, such as digital video broadcasting-terrestrial (DVB-T) signals, for watching radio channels.

Since a frequency domain of a GPS signal is significantly separated from a frequency domain of a DIMO TV signal, it is impossible for a conventional electronic product to receive and to integrate both the GPS signal and the DIMO TV signal simultaneously. For example, a frequency domain of a DIMO TV signal from digital video broadcasting-terrestrial is classified into a first frequency domain lying within the Very High Frequency (VHF) band, which ranges between 30 MHz and 300 MHz, and a second frequency domain lying within the Ultra High Frequency (UHF) band, which ranges between 300 MHz and 3000 MHz. The first frequency domain roughly ranges between 150 MHz and 250 MHz. The second frequency domain roughly ranges between 450 MHz and 900 MHz. A frequency domain of a GPS signal lies roughly above 1500 MHz. The three abovementioned frequency domains are not overlapped with each other. Therefore, an electronic product capable of receiving and integrating signals of the three abovementioned frequency domains is required to acquire a bandwidth of at least 1300 MHz. It indicates the fact that a huge bottleneck will be met while designing an electronic product having such a huge bandwidth.

SUMMARY OF THE INVENTION

The claimed invention provides an electronic device for integrating a GPS antenna and a DIMO TV antenna. The electronic device comprises an antenna module and a receiving module. The antenna module comprises a first antenna for receiving a first GPS signal, a low noise amplifier (LNA) having a first input terminal coupled to the first antenna, a second antenna for receiving a first DIMO TV signal, a first filter module coupled to both the LNA and the second antenna, for filtering both the first GPS signal and the first DIMO TV signal to generate a second GPS signal and a second DIMO TV signal, for receiving a first DC voltage, and for filtering out noise within said first DC voltage to input the filtered first DC voltage to the LNA. A mix signal is generated by mixing the second GPS signal with the second DIMO TV signal. A receiving module comprises a second filter module coupled to the first filter module for receiving the mix signal, for filtering both the second GPS signal and the second DIMO TV signal, for generating a third GPS signal, a third DIMO TV signal, and a fourth DIMO TV signal, for receiving a second DC voltage, and for filtering out noise within said second DC voltage to generate the first DC voltage. A frequency domain of the third DIMO TV signal lies within the frequency domain of the VHF band, and a frequency domain of the fourth DIMO TV signal lies within the frequency domain of the UHF band.

The claimed invention also provides an antenna module for integrating signals of a GPS antenna and a DIMO TV antenna. The antenna module comprises a first antenna for receiving a first GPS signal, a LNA having a first input terminal coupled to the first antenna, a second antenna for receiving a first DIMO TV signal, and a first filter module coupled to both the LNA and the second antenna, for filtering both the first GPS signal and the first DIMO TV signal to generate both a second GPS signal and a second DIMO TV signal. A mix signal is generated by mixing the second GPS signal with the second DIMO TV signal.

These and other objectives of the present invention will no doubt become obvious to those of ordinary skill in the art after reading the following detailed description of the preferred embodiment that is illustrated in the various figures and drawings.

DETAILED DESCRIPTION

Therefore, the present invention provides an electronic device and an antenna module for integrating a GPS antenna and a DIMO TV antenna to solve the abovementioned defect.

Figure 1:
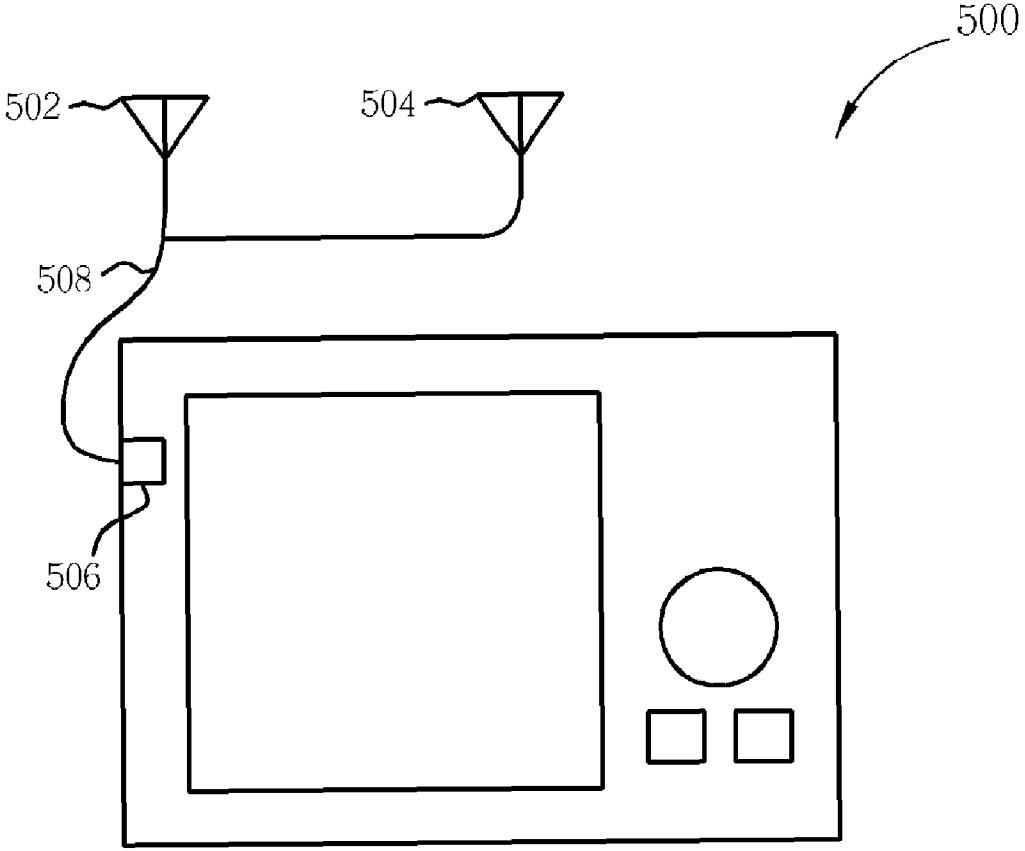
FIG. 1 is a schematic diagram of an electronic device for integrating both a GPS antenna and a DIMO TV antenna according to the present invention.

Please refer to FIG. 1, which is a schematic diagram of an electronic device 500 for integrating both a GPS antenna and a DIMO TV antenna according to the present invention. As shown in FIG. 1, the electronic device 500 includes a first antenna 502 and a second antenna 504, wherein both the first antenna 502 and the second antenna 504 are connected to a core of the electronic device 500 with both a cable 508 and a slot 506. The first antenna 502 is utilized for receiving a GPS signal. The second antenna 504 is utilized for receiving a DIMO TV signal. When the first antenna 502 and the second antenna 504 receive a GPS and a DIMO TV signal respectively, the GPS and the DIMO TV signal are directly mixed and transmitted through the cable 508 into the electronic device 500.

Figure 2:
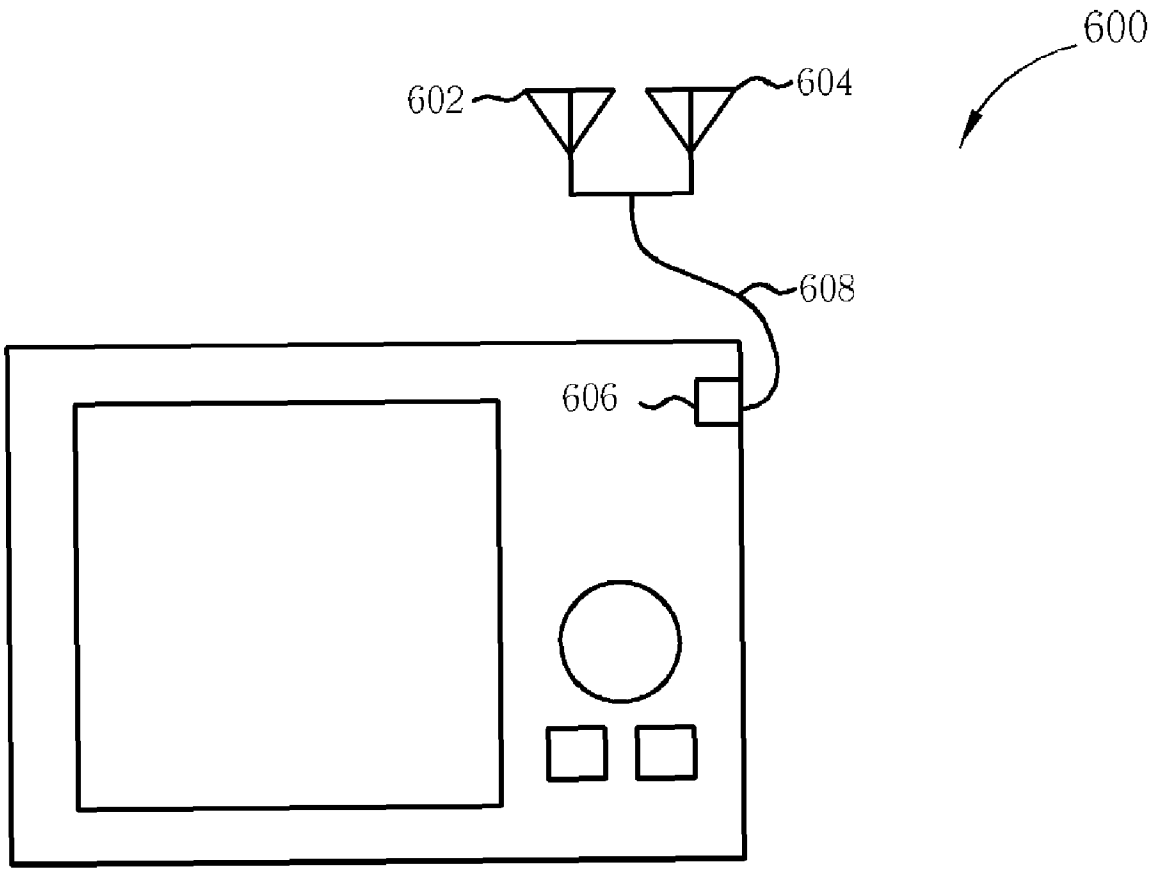
FIG. 2 is a schematic diagram of an electronic device having a smaller volume for integrating both a GPS antenna and a DIMO TV antenna according to the present invention.

Please refer to FIG. 2, which is a schematic diagram of an electronic device 600 having a smaller volume for integrating both a GPS antenna and a DIMO TV antenna according to the present invention. The electronic device 600 is similar with the electronic device 500 in conformation. A primary difference between the electronic devices 500 and 600 lies in the fact that a first antenna 602 and a second antenna 604 of the electronic device 600 may be combined into a single module so that the electronic device 600 is smaller than the electronic device 500 in size.

Figure 3:
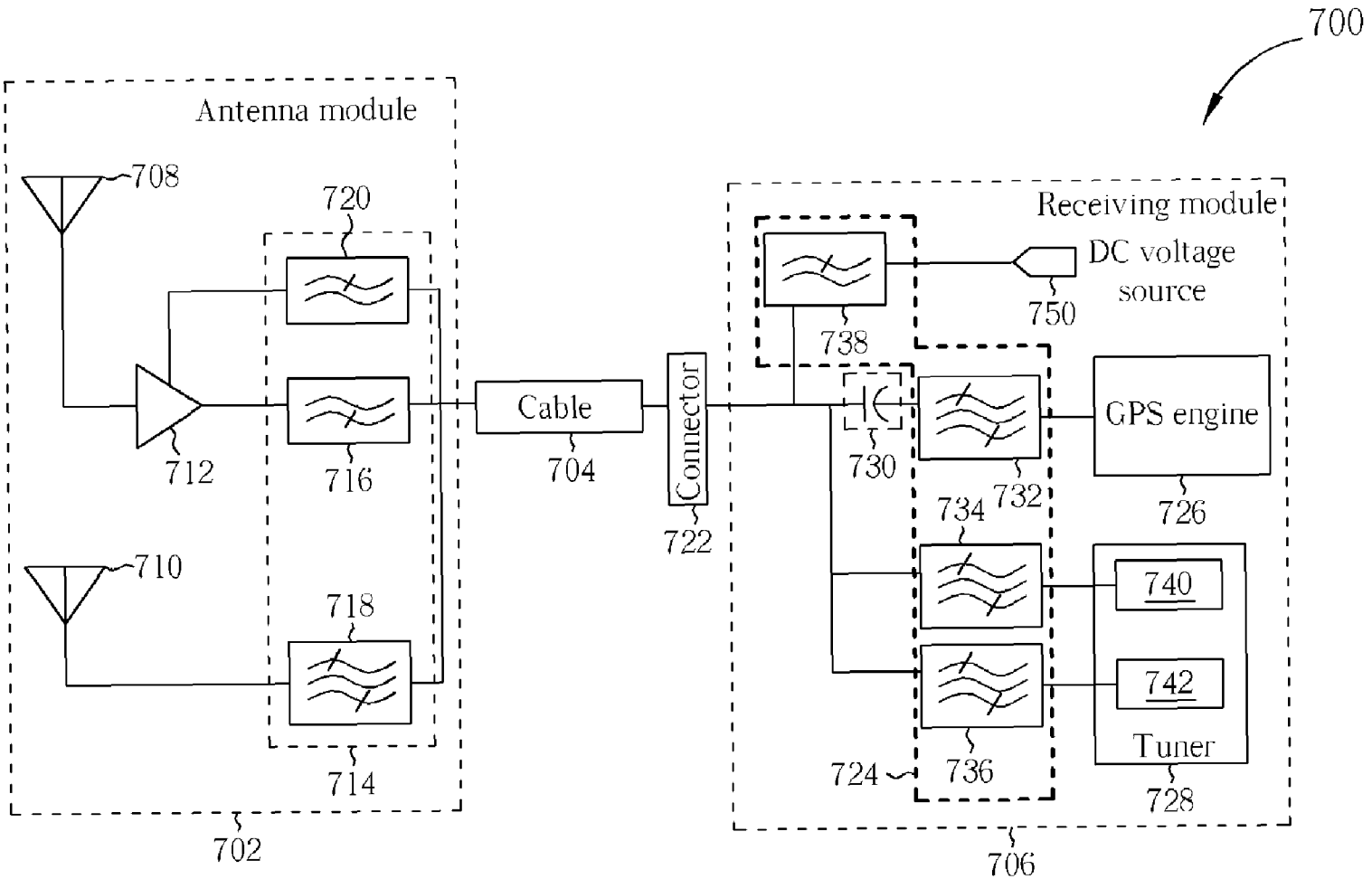
FIG. 3 is a diagram of an electronic device for integrating both a GPS antenna and a DIMO TV antenna according to a preferred embodiment of the present invention.

Please refer to FIG. 3, which is a diagram of an electronic device 700 for integrating both a GPS antenna and a DIMO TV antenna according to a preferred embodiment of the present invention. The electronic device 700 includes an antenna module 702, a cable 704, a connector 722, and a receiving module 706. The antenna module 702 includes a first antenna 708, a second antenna 710, a LNA 712, and a first filter module 714. The first antenna 708 is utilized for receiving a first GPS signal. The second antenna 710 is utilized for receiving a first DIMO TV signal. The LNA 712 has a first input terminal coupled to the first antenna 708, for amplifying the first GPS signal into a second GPS signal. The first filter module 714 includes a first filter 716, a second filter 718, and a third filter 720. The first filter 716 has an input terminal coupled to the output terminal of the LNA 712 for filtering the second GPS signal to generate a third GPS signal. The second filter 718 has an input terminal coupled to the second antenna 710 for filtering the first DIMO TV signal to generate a second DIMO TV signal. The third filter 720 has an input terminal coupled to both an output terminal of the first filter 716 and an output terminal of the second filter 718, and an output terminal coupled to a second input terminal of the LNA 712. The third filter 720 is utilized for filtering a first DC voltage, which is inputted at the input terminal of the third filter 720, to generate a second DC voltage, and for inputting the second DC voltage at the second input terminal of the LNA 712 to provide an operating voltage for the LNA 712. The cable 704 has a first terminal coupled to the output terminal of the first filter 716, the output terminal of the second filter 718, and the input terminal of the third filter 720. The cable 704 is utilized for receiving and transmitting a mix signal generated by mixing the third GPS signal with the second DIMO TV signal, and for transmitting the first DC voltage to the third filter 720. The connector 722 has a first terminal coupled to a second terminal of the cable 704 for receiving the mix signal transmitted by the cable 704, and for transmitting the first DC voltage to the cable 704. It indicates the fact that the connector 722 is utilized for implementing functions of the slots 506 and 606 shown in FIG. 1 and FIG. 2 respectively. Note that when the antenna module 702 is disposed inside the electronic device 700, the cable 704 and the connector 722 can be omitted. The receiving module 706 includes a second filter module 724, a GPS engine 726, a tuner 728, a first capacitor 730, and a DC voltage source 750. The first capacitor 730 has a first terminal coupled to a second terminal of the connector 722 for preventing the first DC voltage from being transmitted through the first capacitor 730 with the mix signal. Note that the mix signal is not affected by the first capacitor 730. The second filter module 724 includes a fourth filter 732, a fifth filter 734, and a sixth filter 736, and a seventh filter 738. The fourth filter 732 has an input terminal coupled to a second terminal of the first capacitor 730, for receiving the mix signal through the connector 722 and the first capacitor 730, and for filtering the mix signal to generate a fourth GPS signal according to an adequate frequency domain of a GPS signal. The GPS engine 726 has an input terminal coupled to an output terminal of the fourth filter 732 for receiving the fourth GPS signal and for performing related processes. The fifth filter 734 has an input terminal coupled to the second terminal of the connector 722 for receiving and filtering the mix signal to generate a third DIMO TV signal having a frequency lying within the VHF band. The sixth filter 736 has an input terminal coupled to the second terminal of the connector 722, for receiving the mix signal, and for filtering the mix signal to generate a fourth DIMO TV signal having a frequency lying within the UHF band. The tuner 728 includes a first DIMO TV signal module 740 and a second DIMO TV signal module 742. The first DIMO TV signal module 740 has an input terminal coupled to the output terminal of the fifth filter 734, for specifically processing a DIMO TV signal lying within the VHF band, i.e., the third DIMO TV signal. The second DIMO TV signal module 742 has an input terminal coupled to the output terminal of the sixth filter 736 for specifically processing a DIMO TV signal lying within the UHF band, i.e., the fourth DIMO TV signal. The seventh filter 738 has an output terminal coupled to the second terminal of the connector 722, and an input terminal coupled to the DC voltage source 750. The DC voltage source 750 is utilized for generating a third DC voltage. The seventh filter 738 is utilized for filtering out noise from the third DC voltage to generate the first DC voltage, and for transmitting the first DC voltage to the connector 722.

Figure 4:
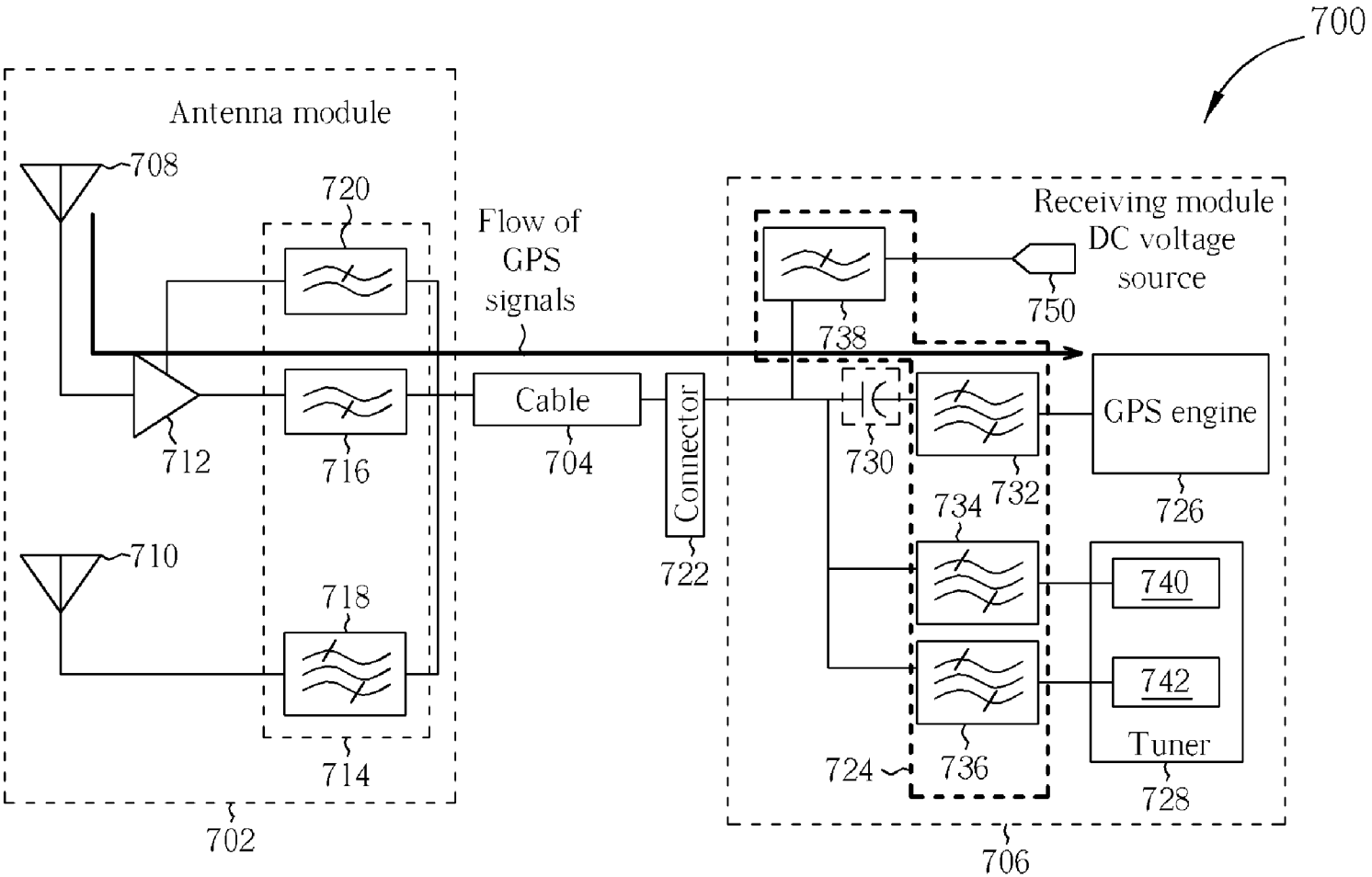
FIG. 4 illustrates a path of GPS signals transmitted with the electronic device shown in FIG. 3.
Figure 5:
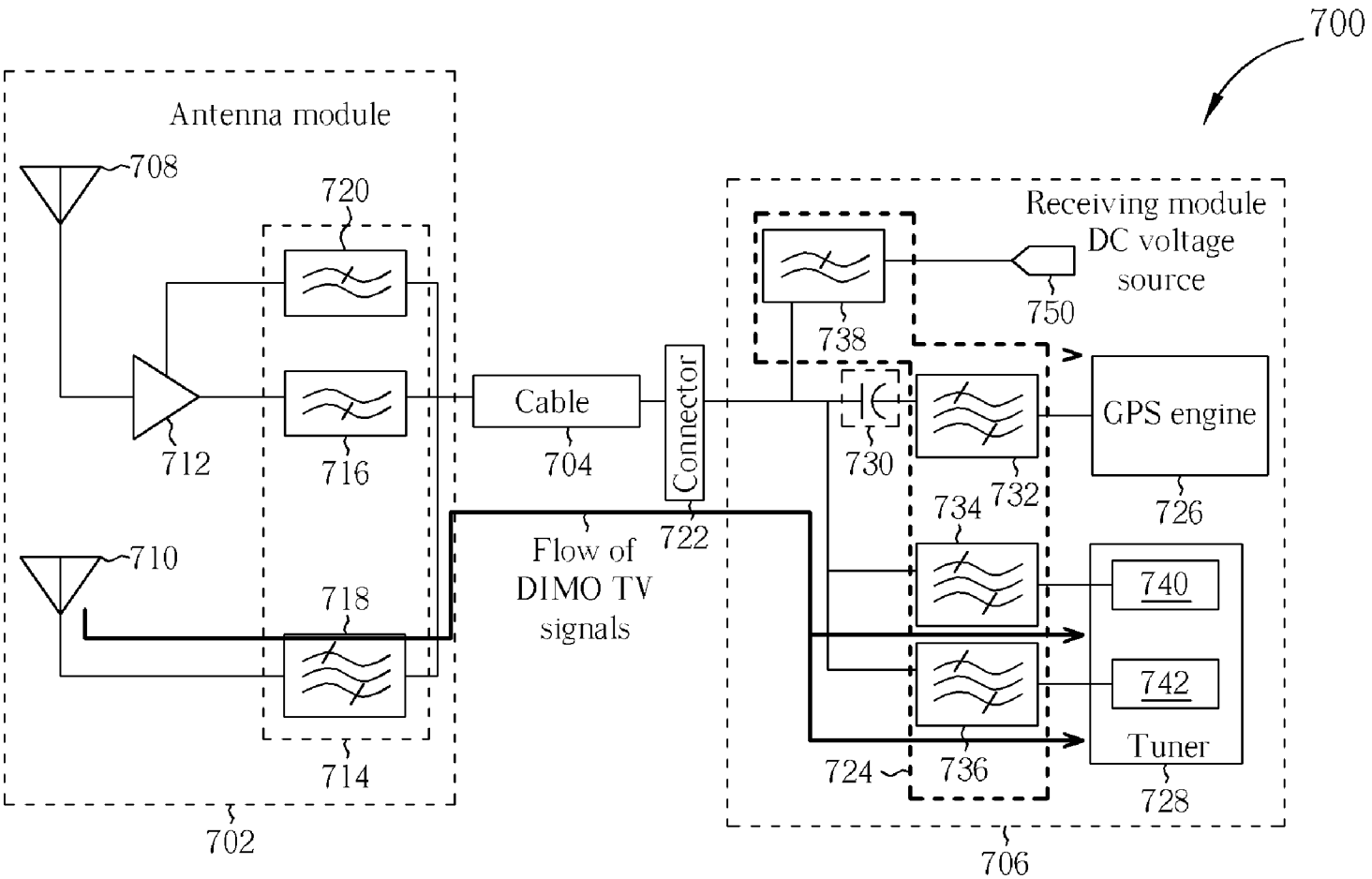
FIG. 5 illustrates a path of DIMO TV signals transmitted within the electronic device shown in FIG. 3.
Figure 6:
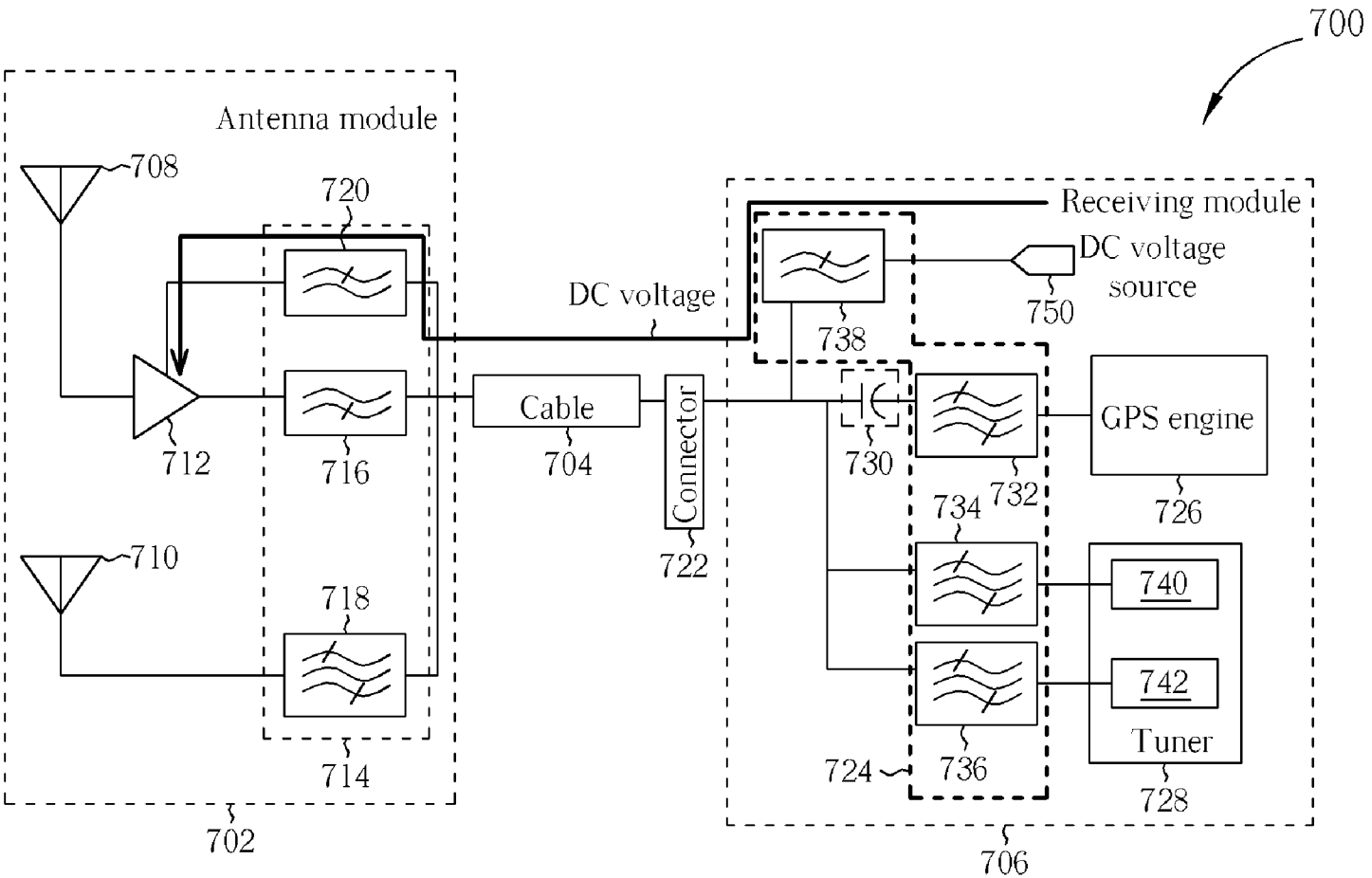
FIG. 6 illustrates a path of DC voltages transmitted within the electronic device shown in FIG. 3.

Please refer to FIG. 4, FIG. 5, FIG. 6 and FIG. 3. FIG. 4 illustrates a path of GPS signals transmitted with the electronic device 700 shown in FIG. 3. FIG. 5 illustrates a path of DIMO TV signals transmitted within the electronic device 700. FIG. 6 illustrates a path of DC voltages transmitted within the electronic device 700. All the above-illustrated paths are distributed according to the descriptions of FIG. 3, and are thus not described further.

Figure 7:
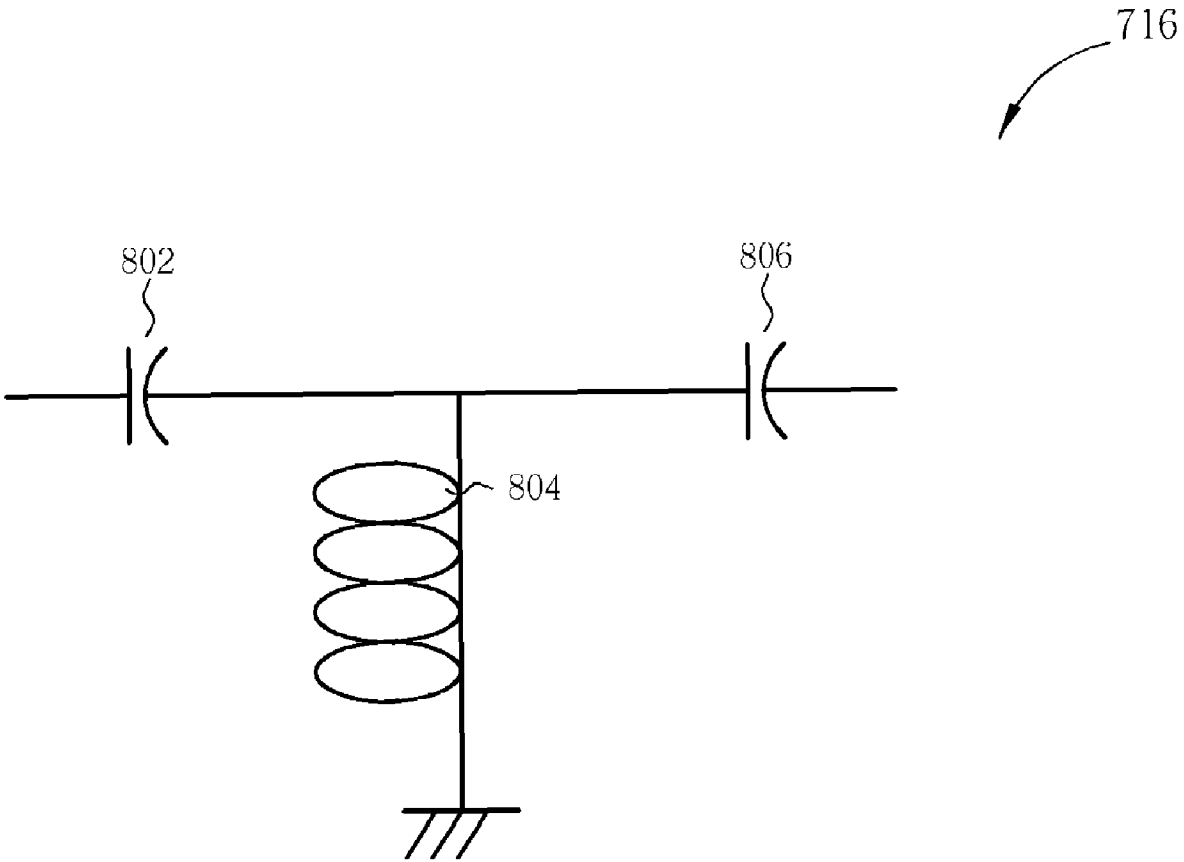
FIG. 7 is a diagram of the first filter shown in FIG. 3 according to a preferred embodiment of said first filter.

Please refer to FIG. 7, which is a diagram of the first filter 716 shown in FIG. 3 according to a preferred embodiment. The first filter 716 may be a high-pass filter specifically designed for a frequency domain of a GPS signal, and may also be a high-pass filter including inductors and capacitors as shown in FIG. 7, for filtering out noise from the first GPS signal. According to the preferred embodiment, the first filter 716 includes a second capacitor 802, a first inductor 804, and a third capacitor 806. The second capacitor 802 has a first terminal coupled to the output terminal of the LNA 712 shown in FIG. 3. The first inductor 804 has a first terminal coupled to a second terminal of the second capacitor 802, and a second terminal coupled to ground. The third capacitor 806 has a first terminal coupled to both the second terminal of the second capacitor 802 and the first terminal of the first inductor 804, and a second terminal coupled to the first terminal of the cable 704 shown in FIG. 3. In the preferred embodiment of the first filter 716, a capacitance of the second capacitor 802 is 1 pF, an inductance of the first inductor 804 is 5.6 nH, and a capacitance of the third capacitor 806 is 1 pF.

Figure 8:
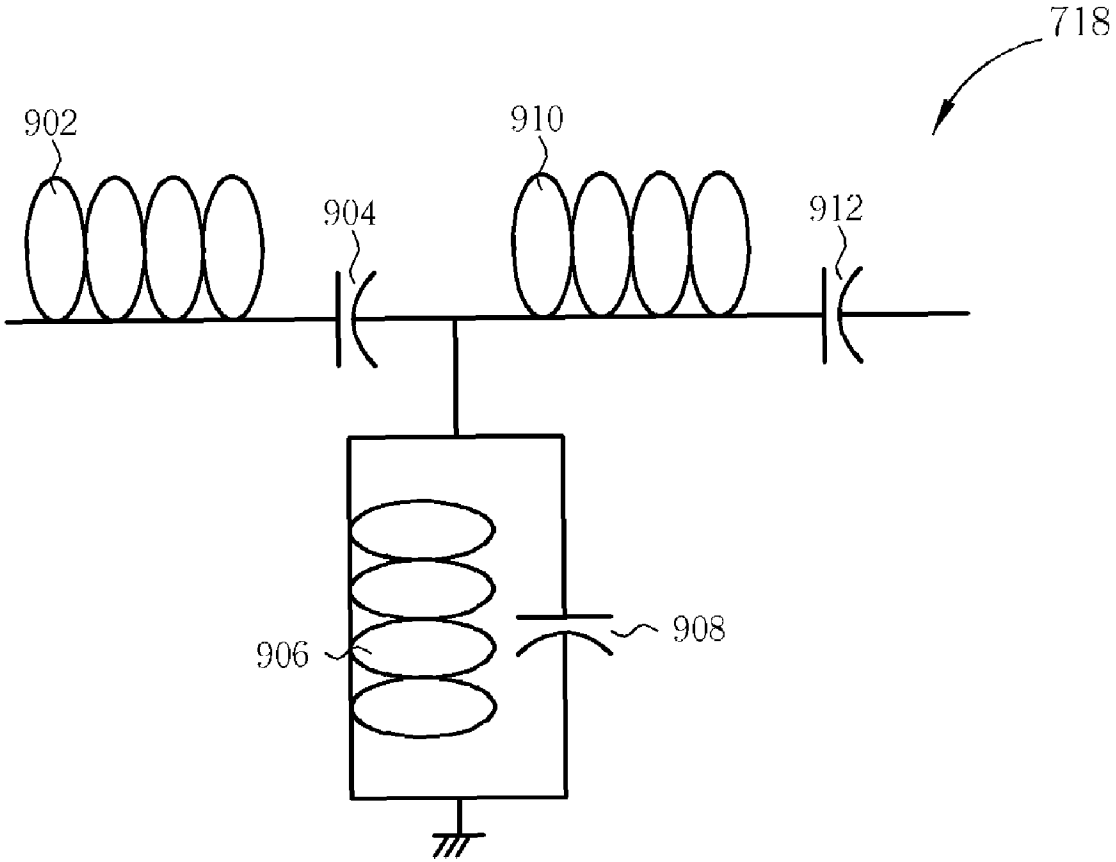
FIG. 8 is a diagram of the second filter shown in FIG. 3 according to a preferred embodiment of said second filter.

Please refer to FIG. 8, which is a diagram of the second filter 718 shown in FIG. 3 according to a preferred embodiment. The second filter 718 is specifically designed for filtering out noise from DIMO TV signals lying within the VHF or UHF bands. Therefore, the second filter 718 has to be a filter, includes inductors and capacitors, having a larger bandwidth for covering both of the VHF and UHF bands. As shown in FIG. 8, the second filter 718 includes a first inductor 902, a second capacitor 904, a second inductor 906, a third capacitor 908, a third inductor 910, and a fourth capacitor 912. The first inductor 902 has a first terminal coupled to the second antenna 710 shown in FIG. 3. The second capacitor 904 has a first terminal coupled to a second terminal of the first inductor 902. The second inductor 906 has a first terminal coupled to a second terminal of the second capacitor 904, and a second terminal coupled to ground. The third capacitor 908 has a first terminal coupled to the second terminal of the second capacitor 904, and a second terminal coupled to ground. As shown in FIG. 8, the second inductor 906 and the third capacitor 908 are coupled to each other in a parallel connection. The third inductor 910 has a first terminal coupled to the second terminal of the second capacitor 904, to the first terminal of the second inductor 906, and to the first terminal of the third capacitor 908. The fourth capacitor 912 has a first terminal coupled to a second terminal of the third inductor 910, and a second terminal coupled to the first terminal of the cable 704 shown in FIG. 3. In the preferred embodiment of the second filter 718, the first inductor 902 has an inductance of 22 nH, the second capacitor 904 has a capacitance of 8.2 pF, the second inductor 906 has an inductance of 33 nH, the third capacitor 908 has a capacitance of 4.2 pF, the third inductor 910 has an inductance of 22 nH, and the fourth capacitor 912 has a capacitance of 8.2 pF.

Figure 9:
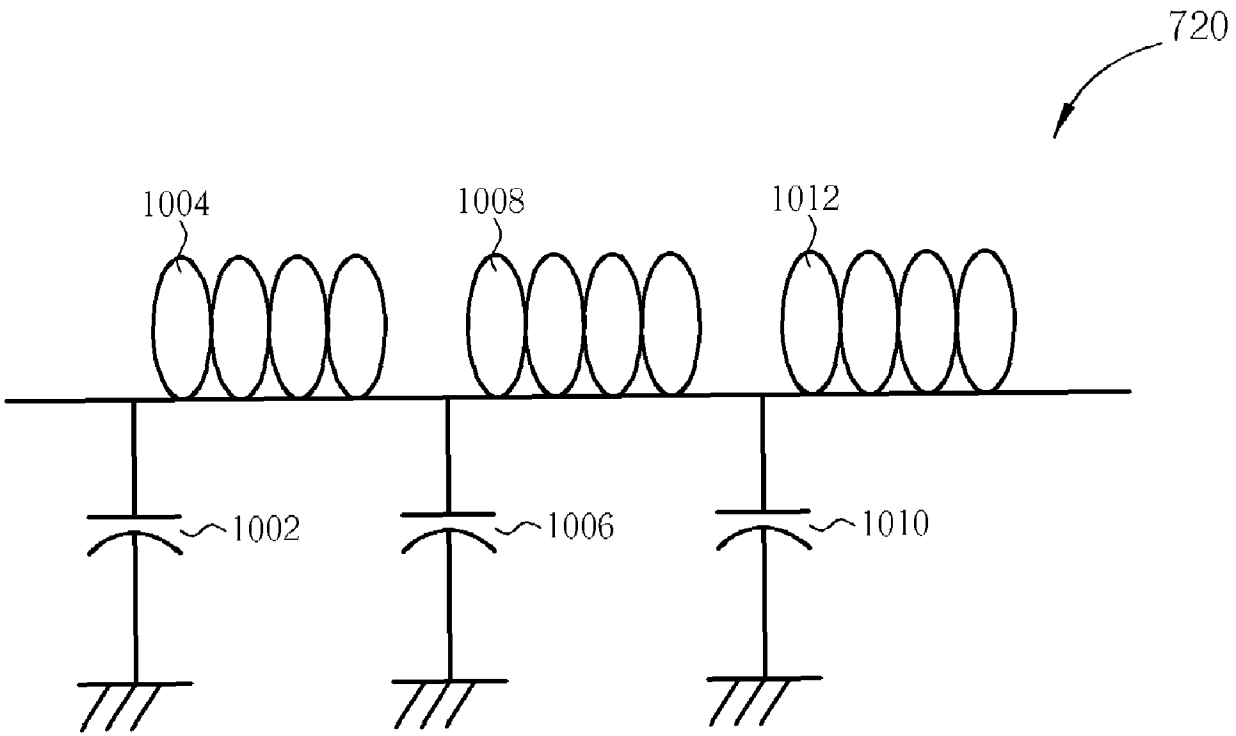
FIG. 9 is a diagram of the third filter shown in FIG. 3 according to a preferred embodiment of said third filter.

Please refer to FIG. 9, which is a diagram of the third filter 720 shown in FIG. 3. The third filter 720 is utilized for providing a supply path of a DC voltage required by the LNA 712 shown in FIG. 3. Therefore, the third filter 720 may be implemented with a filter having a smaller bandwidth, or with a combination of a plurality of capacitors and inductors in layers, for reducing a degree of the required DC voltage affecting on other signals in the electronic device 700, more particularly, on DIMO TV signals having a similar frequency domain. As shown in FIG. 9, the third filter 720 includes a second capacitor 1002, a first inductor 1004, a third capacitor 1006, a second inductor 1008, a fourth capacitor 1010, and a third inductor 1012. The second capacitor 1002 has a first terminal coupled to the second input terminal of the LNA 712, and a second terminal coupled to ground. The first inductor 1004 has a first terminal coupled to both the second input terminal of the LNA 712 and the first terminal of the second capacitor 1002. The third capacitor 1006 has a first terminal coupled to a second terminal of the first inductor 1004, and a second terminal coupled to ground. The second inductor 1008 has a first terminal coupled to both the second terminal of the first inductor 1004 and the first terminal of the third capacitor 1006. The fourth capacitor 1010 has a first terminal coupled to a second terminal of the second inductor 1008, and a second terminal coupled to ground. The third inductor 1012 has a first terminal coupled to both the second terminal of the second inductor 1008 and the first terminal of the fourth capacitor 1010, and a second terminal coupled to the first terminal of the cable 704 shown in FIG. 3. In the preferred embodiment of the third filter 720, the second capacitor 1002 has a capacitance of 22 pF, the first inductor 1004 has an inductance of 100 nH, the third capacitor 1006 has a capacitance of 47 pF, the second inductor 1008 has an inductance of 120 nH, the fourth capacitor 1010 has a capacitance of 150 pF, and the third inductor 1012 has an inductance of 100 nH. All of the first inductor 1004, the second inductor 1008, and the third inductor 1012 may be implemented with a radio frequency choke (RFC) respectively.

Since the frequency domain of the GPS signal is not wide, the required bandwidth for filtering the GPS signal is small. For preventing unnecessary noise from mixing with the GPS signal, the fourth filter 732 may be implemented with a surface acoustic wave (SAW) filter.

Since the circuitry of the fifth filter 734 and the sixth filter 736 are the same as the second filter 718 shown in FIG. 8, components of the fifth filter 734 and the sixth filter 736 are not described further. In the preferred embodiment of the fifth filter 734, the first inductor has an inductance of 120 nH, the second capacitor has a capacitance of 6 pF, the second inductor has an inductance of 15 nH, the third capacitor has a capacitance of 47 pF, the third inductor has an inductance of 120 nH, and the fourth capacitor has a capacitance of 6 pF.

In the preferred embodiment of the sixth filter 736, the first inductor has an inductance of 20 nH, the second capacitor has a capacitance of 2.6 pF, the second inductor has an inductance of 12 nH, the third capacitor has a capacitance of 6 pF, the third inductor has an inductance of 6 nH, and the fourth capacitor has a capacitance of 1000 pF.

Figure 10:
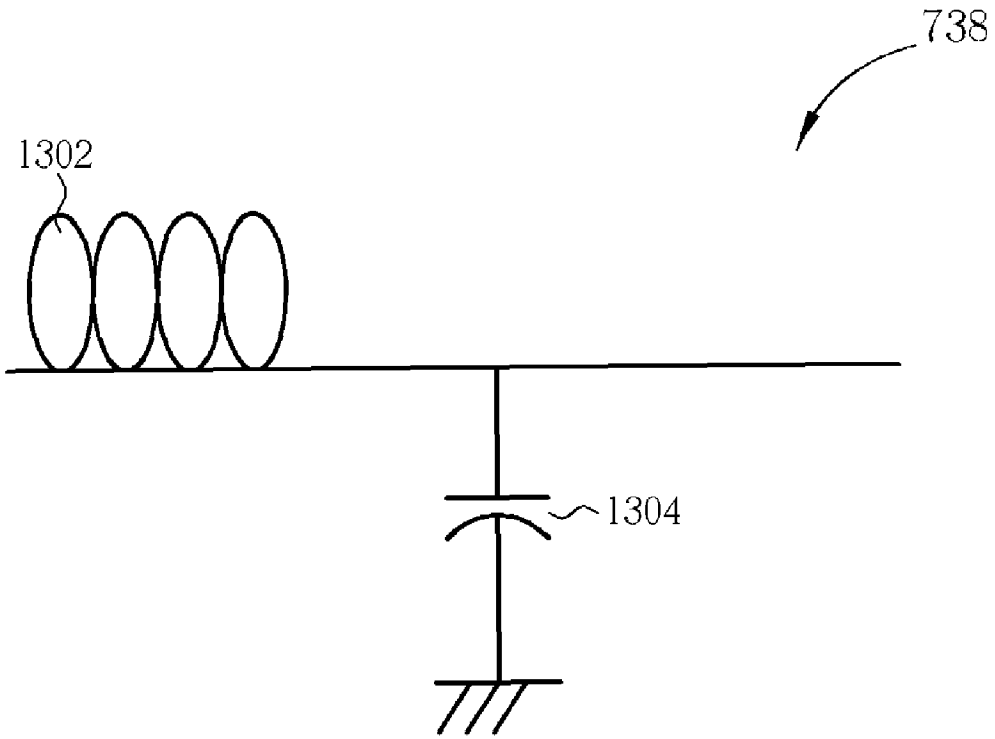
FIG. 10 is a diagram of the seventh filter shown in FIG. 3 according to a preferred embodiment of said seventh filter.

Please refer to FIG. 10, which is a diagram of the seventh filter 738 shown in FIG. 3. As mentioned above, the seventh filter 738 is utilized for filtering out noise from the DC voltage inputted from the DC voltage source 750 shown in FIG. 6. Moreover, the seventh filter 738 is required to be a low-pass filter having a small bandwidth for reducing a degree that the inputted DC voltage affects on a DIMO TV signal, which lies within the VHF band and has a frequency domain close to a frequency domain of the inputted DC voltage. As shown in FIG. 10, the seventh filter 738 includes a first inductor 1302 and a second capacitor 1304. The first inductor 1302 has a first terminal coupled to the second terminal of the connector 722 shown in FIG. 3, and a second terminal coupled to the DC voltage source 750. The second capacitor 1304 has a first terminal coupled to both the second terminal of the first inductor 1302 and the DC voltage source 750, and a second terminal coupled to ground. In the preferred embodiment of the seventh filter 738, the first inductor 1302 has an inductance of 100 nH, and the second capacitor 1304 has a capacitance of 22 pF. Moreover, the first inductor 1302 may be implemented with a radio frequency chock.

In a preferred embodiment of the present invention, an applied DC voltage conventionally lies within a frequency domain below 100 MHz. A DIMO TV signal lying within the VHF band and generated by the electronic device 700 of the present invention conventionally lies within a frequency domain between 177.5 MHz and 226.5 MHz. A DIMO TV signal lying within the UHF band and generated by the electronic device 700 of the present invention conventionally lies within a frequency domain between 474.0 MHz and 858.0 MHz. A GPS signal generated by the electronic device 700 of the present invention conventionally lies along a frequency domain of about 1575.42 MHz with a standard deviation of 10 MHz, i.e., between 1565.42 MHz and 1585.42 MHz.

Those skilled in the art will readily observe that numerous modifications and alterations of the device and method may be made while retaining the teachings of the invention.

What is claimed is:

1. An electronic device for integrating a global positioning system antenna and a digital mobile television antenna, comprising:

an antenna module, comprising:

a first antenna for receiving a first global positioning system signal;

a low noise amplifier having a first input terminal coupled to the first antenna;

a second antenna for receiving a first digital mobile television signal;

a first filter module coupled to the low noise amplifier and the second antenna, for filtering the first global positioning system signal and the first digital mobile television signal to generate a second global positioning system signal and a second digital mobile television signal, for receiving a first DC voltage, and for filtering out noise from said first DC voltage to input the filtered first DC voltage to the low noise amplifier, wherein a mix signal is generated by mixing the second global positioning system signal with the second digital mobile television signal; and a receiving module comprising:

a second filter module coupled to the first filter module for receiving the mix signal, for filtering both the second global positioning system signal and the second digital mobile television signal, for generating a third global positioning system signal, a third digital mobile television signal, and a fourth digital mobile television signal, for receiving a second DC voltage, and for filtering out noise from said second DC voltage to generate the first DC voltage;

wherein a frequency domain of the third digital mobile television signal lies within the frequency domain of Very High Frequency (VHF), and a frequency domain of the fourth digital mobile television signal lies within the frequency domain of Ultra High Frequency (UHF).

2. The electronic device of claim 1, wherein the first filter module comprises:

a first filter having an input terminal coupled to the output terminal of the low noise amplifier, wherein the first filter is utilized for filtering the first global positioning system signal to generate the second global positioning system signal;

a second filter having an input terminal coupled to the second antenna, wherein the second filter is utilized for filtering the first digital mobile television signal to generate the second digital mobile television signal, and an output terminal of the first filter is coupled to an output terminal of the second filter; and a third filter having an input terminal coupled to the output terminal of the second filter, and having an output terminal coupled to the second input terminal of the low noise amplifier, for receiving the first DC voltage, for filtering out noise from said DC voltage, and for inputting the filtered DC voltage to the low noise amplifier.

3. The electronic device of claim 1, wherein the second filter module comprises:

a fourth filter having an input terminal coupled to the antenna module, for filtering the mix signal to generate the third global positioning system signal;

a fifth filter having an input terminal coupled to the antenna module, for filtering the mix signal to generate the third digital mobile television signal;

a sixth filter having an input terminal coupled to the antenna module, for filtering the mix signal to generate the fourth digital mobile television signal; and a seventh filter having an output terminal coupled to the antenna module, for receiving the second DC voltage, and for filtering out noise from said second DC voltage to generate the first DC voltage.

4. The electronic device of claim 2, wherein the second filter module comprises:

a fourth filter having an input terminal coupled to the antenna module, for filtering the mix signal to generate the third global positioning system signal;

a fifth filter having an input terminal coupled to the antenna module, for filtering the mix signal to generate the third digital mobile television signal;

a sixth filter having an input terminal coupled to the antenna module, for filtering the mix signal to generate the fourth digital mobile television signal; and a seventh filter having an output terminal coupled to the antenna module, for receiving a second DC voltage, and for filtering out noise from said second DC voltage to generate the first DC voltage.

5. The electronic device of claim 1 further comprising:

a cable having a first terminal coupled to the antenna module for transmitting the mix signal; and a connector having a first terminal coupled to a second terminal of the cable, and having a second terminal connected to the receiving module for receiving the mix signal.

6. The electronic device of claim 3, wherein the receiving module further comprises:

a first capacitor having a first terminal coupled to the antenna module;

a global positioning system engine having an input terminal coupled to an output terminal of the fourth filter, for receiving the third global positioning system signal;

a tuner comprising:

a first digital mobile television channel module having an input terminal coupled to an output terminal of the fifth filter, for receiving the third digital mobile television signal; and a second digital mobile television channel module having an input terminal coupled to an output terminal of the sixth filter, for receiving the fourth digital mobile television signal; and a DC voltage source coupled to an input terminal of the seventh filter, for generating the second DC voltage.

7. The electronic device of claim 3, wherein the fourth filter is a surface acoustic wave filter.

8. The electronic device of claim 3, wherein the fifth filter comprises:

a first inductor;

a second capacitor having a first terminal coupled to the second terminal of the first inductor;

a second inductor having a first terminal coupled to the second terminal of the second capacitor, and having a second terminal coupled to ground;

a third capacitor having a first terminal coupled to the second terminal of the second capacitor, and having a second terminal coupled to ground, wherein the third capacitor and the second inductor are coupled to each other in a parallel connection;

a third inductor having a first terminal coupled to the second terminal of the second capacitor; and a fourth capacitor having a first terminal coupled to the second terminal of the third inductor, and having a second terminal coupled to an input terminal of a first digital mobile television channel module.

9. The electronic device of claim 3, wherein the sixth filter comprises:

a first inductor;

a second capacitor having a first terminal coupled to a second terminal of the first inductor;

a second inductor having a first terminal coupled to the second terminal of the second capacitor, and having a second terminal coupled to ground;

a third capacitor having a first terminal coupled to the second terminal of the second capacitor, and having a second terminal coupled to ground, wherein the third capacitor and the second inductor are coupled to each other in a parallel connection;

a third inductor having a first terminal coupled to the second terminal of the second capacitor; and a fourth capacitor having a first terminal coupled to the second terminal of the third inductor, and having a second terminal coupled to an input terminal of a second digital mobile television channel module.

10. The electronic device of claim 3, wherein the seventh filter comprises:

a first inductor having a second terminal coupled to a DC voltage source; and a second capacitor having a first terminal coupled to a second terminal of the first inductor and a second terminal coupled to ground.

11. The electronic device of claim 2, wherein the third filter comprises:

a second capacitor having a first terminal coupled to the second input terminal of the low noise amplifier, and having a second terminal coupled to ground;

a first inductor having a first terminal coupled to the second input terminal of the low noise amplifier;

a third capacitor having a first terminal coupled to a second terminal of the first inductor, and having a second terminal coupled to ground;

a second inductor having a first terminal coupled to the second terminal of the first inductor;

a fourth capacitor having a first terminal coupled to the second terminal of the second inductor, and having a second terminal coupled to ground; and a third inductor having a first terminal coupled to the second terminal of the second inductor, and having a second terminal coupled to the output terminal of the second filter.

12. The electronic device of claim 2, wherein the first filter is a high-pass filter.

13. The electronic device of claim 2, wherein the first filter comprises:

a second capacitor having a first terminal coupled to the output terminal of the low noise amplifier;

a first inductor having a first terminal coupled to the second terminal of the second capacitor, and having a second terminal coupled to ground; and a third capacitor having a first terminal coupled to the second terminal of the second capacitor, and having a second terminal coupled to the output terminal of the second filter.

14. An antenna module for integrating signals of a global positioning system antenna and a digital mobile television antenna comprising:

a first antenna for receiving a first global positioning system signal;

a low noise amplifier having a first input terminal coupled to the first antenna;

a second antenna for receiving a first digital mobile television signal; and a first filter module coupled to both the low noise amplifier and the second antenna, for filtering both the first global positioning system signal and the first digital mobile television signal to generate a second global positioning system signal and a second digital mobile television signal, wherein a mix signal is generated by mixing the second global positioning system signal with the second digital mobile television signal.

15. The antenna module of claim 14, wherein the first filter module comprises:

a first filter having an input terminal coupled to the output terminal of the low noise amplifier, for filtering the first global positioning system signal to generate the second global positioning system signal;

a second filter having an input terminal coupled to the second antenna, and having an output terminal coupled to the output terminal of the first filter, for filtering the first digital mobile television signal to generate the second digital mobile television signal; and a third filter having an input terminal coupled to the output terminal of the second filter, and having an output terminal coupled to the second input terminal of the low noise amplifier.

16. The antenna module of claim 15, wherein the first filter is a high-pass filter.

17. The antenna module of claim 15, wherein the first filter comprises:

a second capacitor having a first terminal coupled to the output terminal of the low noise amplifier;

a first inductor having a first terminal coupled to the second terminal of the second capacitor, and having a second terminal coupled to ground; and a third capacitor having a first terminal coupled to the second terminal of the second capacitor, and having a second terminal coupled to the output terminal of the second filter.

18. The antenna module of claim 15, wherein the second filter comprises:

a first inductor having a first terminal coupled to the second antenna;

a second capacitor having a first terminal coupled to the second terminal of the first inductor;

a second inductor having a first terminal coupled to the second terminal of the second capacitor, and having a second terminal coupled to ground;

a third capacitor having a first terminal coupled to the second terminal of the second capacitor, and having a second terminal coupled to ground, wherein the third capacitor and the second inductor are coupled to each other in a parallel connection;

a third inductor having a first terminal coupled to the second terminal of the second capacitor; and a fourth capacitor having a first terminal coupled to the second terminal of the third inductor.

19. The antenna module of claim 15, wherein the third filter comprises:

a second capacitor having a first terminal coupled to the second input terminal of the low noise amplifier, and having a second terminal coupled to ground;

a first inductor having a first terminal coupled to the second input terminal of the low noise amplifier;

a third capacitor having a first terminal coupled to the second terminal of the first inductor and a second terminal coupled to ground;

a second inductor having a first terminal coupled to the second terminal of the first inductor;

a fourth capacitor having a first terminal coupled to the second terminal of the second inductor, and having a second terminal coupled to ground; and a third inductor having a first terminal coupled to the second terminal of the second inductor.

* * * * *